US008200142B2

(12) United States Patent
Vetromile et al.

(10) Patent No.: US 8,200,142 B2
(45) Date of Patent: Jun. 12, 2012

(54) MULTI-JOB FEEDER APPARATUS AND METHOD

(75) Inventors: Joseph S Vetromile, Rochester, NY (US); Kenneth P Moore, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 896 days.

(21) Appl. No.: 12/034,197

(22) Filed: Feb. 20, 2008

(65) Prior Publication Data

US 2009/0206153 A1 Aug. 20, 2009

(51) Int. Cl.
*G03G 15/00* (2006.01)

(52) U.S. Cl. ..... 399/382; 399/84; 399/388; 271/264

(58) Field of Classification Search ..... 271/9.05, 271/9.07, 9.08, 162, 265.01, 3.14, 4.03, 10.02, 271/110, 264; 399/382, 84, 388; 270/12, 270/52.01, 58.05

See application file for complete search history.

(56) References Cited

U.S. PATENT DOCUMENTS 4,609,283 A * 9/1986 Murata et al. ..... 399/84
4,757,348 A * 7/1988 Rourke et al. ..... 399/84
4,970,554 A * 11/1990 Rourke ..... 399/84
5,227,816 A * 7/1993 Forest ..... 347/153
5,488,458 A 1/1996 Benedict et al.
5,802,440 A * 9/1998 Maeyama ..... 430/45.5
6,457,651 B2 10/2002 Paul et al.
6,985,682 B2 * 1/2006 Haines et al. ..... 399/84
7,102,798 B2 * 9/2006 Haines et al. ..... 358/471

FOREIGN PATENT DOCUMENTS

JP 2000201254 A * 7/2000

* cited by examiner

*Primary Examiner* — Matthew G Marini

(57) ABSTRACT

A method and apparatus for improved productivity and reducing operator induced shut-downs when feeding multiple jobs from a single sheet tray includes providing bar-coded job divider sheets; loading the divider sheets into the sheet supply tray on top of their corresponding sheet stack; providing a bar-code sensor above the sheet supply that reads each divider sheet bar-code information; confirming that the bar-code information matches what is in the job cue; and setting sub-system operating parameters for that paper. Once the first divider sheet is sensed, it is then fed to a purge tray before the job starts. When the job is complete, remaining sheets for that job can be fed (optionally at high speed) to the purge tray on top of the corresponding divider sheet for reuse later. If too few sheets were loaded for the job, the feeder will cause a soft cycle down and flag the problem.

11 Claims, 3 Drawing Sheets

MULTI-JOB FEEDER APPARATUS AND METHOD

This invention relates in general to an image forming apparatus, and more particularly, to an image forming apparatus employing a multi-job feeder tray.

Conventionally, a feeder module in a high-speed imaging apparatus includes two or more sheet capacity media supplies. One paper type in a tray at a time is intended to be loaded, therefore, requiring unloading and reloading with changing paper requirements as the job necessitates. This causes significant delays between jobs, especially for short job lengths. For example, according to field data logs for some machines and especially color machines, 55% of selected print jobs are 50 sheets or less. To minimize delay time, operators have been stacking multiple job stacks of different paper types on top of each other separated by a job divider of various types. This requires trays to be opened to have residual paper and dividers removed after each job, which reduces productivity. In some cases, paper is used up before job completion causing an operator induced shut down (misfeed) when the thick divider is attempted to be fed.

U.S. Pat. No. 5,488,458 discloses a duplex printing integrity system for insuring that correctly matching pages are being printed by a duplex printer on the opposing first and second sides of sheets. The printer is operable to selectively print marks along the sheets and optical sensors on opposite sides of the sheets are used to detect the marks and send signals to a comparison circuit that continuously compares the sensor output signals to provide a duplex printing error signal when the sensors provide different output signals. In U.S. Pat. No. 6,457,651 B2 a dual level encryption method, and document, is provided for obtaining a substantially increased amount of optically readable information from an otherwise conventional and highly visible printed bar-code pattern area on a document without interfering with the conventional optical reading of the conventional information in the bar-code.

While discourses of the above-mentioned patents are useful, they do not answer the operator intervention problem presented when feeding multiple types of paper and printing jobs from a paper feed tray.

Accordingly, a method is disclosed for stacking different types of same-sized sheets for multiple jobs in a paper supply and allowing job streaming without operator intervention and thereby improving productivity and reducing operator induced shut-downs that includes: providing bar-coded job divider sheets printed from information programmed in the stock library; loading the divider sheets into the sheet supply with their corresponding sheet stack; providing a bar-code sensor at the sheet supply that reads each divider sheet bar-code information; confirming that the information matches what is in the job cue; and setting subsystem operating parameters for that paper. Once the first divider sheet is sensed, it is then fed to a predetermined output tray before the job starts. When the job is complete, remaining paper for that job is fed (optionally, at high speed) to the predetermined output tray with the corresponding divider sheet for reuse later. If too few sheets were loaded for the job, the feeder will cause a soft cycle down when it sees the bar-code on the next job divider sheet and flag the problem. Alternatively, an option could be included, such that, if a job is running and the next bar-code is seen before the job is completed (i.e., a misfeed and soft shut down occurs), the system will flag the operator on the user interface (not shown), and use the next bar-coded cover sheet to continue running the job.

The disclosed reprographic system that incorporates the disclosed improved method for stream feeding sheets for multiple jobs from a feed tray may be operated by and controlled by appropriate operation of conventional control systems. It is well-known and preferable to program and execute imaging, printing, paper handling, and other control functions and logic with software instructions for conventional or general purpose microprocessors, as taught by numerous prior patents and commercial products. Such programming or software may, of course, vary depending on the particular functions, software type, and microprocessor or other computer system utilized, but will be available to, or readily programmable without undue experimentation from, functional descriptions, such as, those provided herein, and/or prior knowledge of functions which are conventional, together with general knowledge in the software of computer arts. Alternatively, any disclosed control system or method may be implemented partially or fully in hardware, using standard logic circuits or single chip VLSI designs.

The term 'sheet' herein refers to any flimsy physical sheet or paper, plastic, or other useable physical substrate for printing images thereon, whether precut or initially web fed. A compiled collated set of printed output sheets may be alternatively referred to as a document, booklet, or the like. It is also known to use interposes or inserters to add covers or other inserts to the compiled sets.

As to specific components of the subject apparatus or methods, or alternatives therefor, it will be appreciated that, as normally the case, some such components are known per se' in other apparatus or applications, which may be additionally or alternatively used herein, including those from art cited herein. For example, it will be appreciated by respective engineers and others that many of the particular components mountings, component actuations, or component drive systems illustrated herein are merely exemplary, and that the same novel motions and functions can be provided by many other known or readily available alternatives. All cited references, and their references, are incorporated by reference herein where appropriate for teachings of additional or alternative details, features, and/or technical background. What is well known to those skilled in the art need not be described herein.

Various of the above-mentioned and further features and advantages will be apparent to those skilled in the art from the specific apparatus and its operation or methods described in the example(s) below, and the claims. Thus, they will be better understood from this description of these specific embodiment(s), including the drawing figures (which are approximately to scale) wherein:

Figure 1:
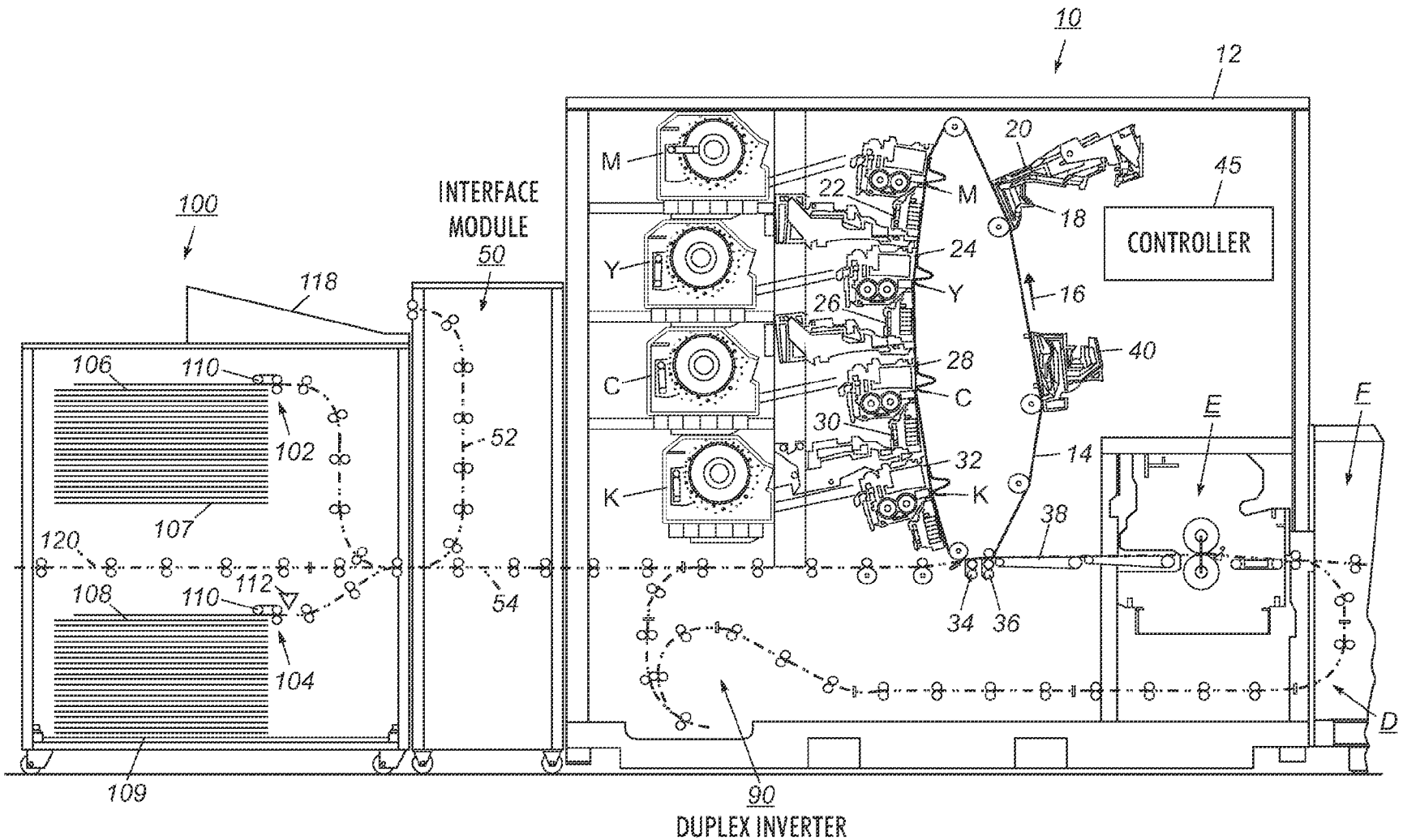
FIG. 1 is a partial, frontal view of an exemplary modular xerographic printer that includes the improved job streaming method of the present disclosure.

While the disclosure will be described hereinafter in connection with a preferred embodiment thereof, it will be understood that limiting the disclosure to that embodiment is not intended. On the contrary, it is intended to cover all alternatives, modifications and equivalents as may be included within the spirit and scope of the disclosure as defined by the appended claims.

The disclosure will now be described by reference to a preferred embodiment xerographic printing apparatus that includes a method of loading multiple types of paper in a feed tray to allow printing of multiple jobs without operator intervention.

For a general understanding of the features of the disclosure, reference is made to the drawings. In the drawings, like reference numerals have been used throughout to identify identical elements.

Referring now to printer 10 in the figure, as in other xerographic machines, and as is well known, shows an electrographic printing system including the improved method and apparatus for feeding multiple types of paper and printing jobs from a paper feed tray embodiment of the present disclosure. The term "printing system" as used here encompasses a printer apparatus, including any associated peripheral or modular devices, where the term "printer" as used herein encompasses any apparatus, such as a digital copier, bookmaking machine, facsimile machine, multifunction machine, et., which performs a print outputting function for any purpose. Marking module 12 includes a photoreceptor belt 14 that advances in the direction of arrow 16 through the various processing stations around the path of belt 14. Charger 18 charges an area of belt 14 to a relatively high, substantially uniform potential. Next, the charged area of belt 14 passes laser 20 to expose selected areas of belt 14 to a pattern of light, to discharge selected areas to produce an electrostatic latent image. Next, the illuminated area of the belt passes developer unit M, which deposits magenta toner on charged areas of the belt.

Subsequently, charger 22 charges the area of belt 14 to a relatively high, substantially uniform potential. Next, the charged area of belt 14 passes laser 24 to expose selected areas of belt 14 to a pattern of light, to discharge selected areas to produce an electrostatic latent image. Next, the illuminated area of the belt passes developer unit Y, which deposits yellow toner on charged areas of the belt.

Subsequently, charger 26 charges the area of belt 14 to a relatively high, substantially uniform potential. Next, the charged area of belt 14 passes laser 28 to expose selected areas of belt 14 to a pattern of light, to discharge selected areas to produce an electrostatic latent image. Next, the illuminated area of the belt passes developer unit C, which deposits cyan toner on charged areas of the belt.

Subsequently, charger 30 charges the area of belt 14 to a relatively high, substantially uniform potential. Next, the charged area of belt 14 passes laser 32 to expose selected areas of belt 14 to a pattern of light, to discharge selected areas to produce an electrostatic latent image. Next, the illuminated area of the belt passes developer unit K, which deposits black toner on charged areas of the belt.

As a result of the processing described above, a full color toner image is now moving on belt 14. In synchronism with the movement of the image on belt 14, a conventional registration system receives copy sheets from sheet feeder module 100 through interface module 50 and brings the copy sheets into contact with the image on belt 14. Sheet feeder module 100 includes high capacity feeders 102 and 104 that feed sheets from sheet stacks 106 and 108 positioned on media supply trays 107 and 109 into interface module 50 that directs them either to purge tray 118 through sheet feed path 52 or to imaging or marking module 12 through sheet feed path 54. Additional high capacity media trays could be added to feed sheets along sheet path 120, if desired.

A corotron 34 charges a sheet to tack the sheet to belt 14 and to move the toner from belt 14 to the sheet. Subsequently, detack corotron 36 charges the sheet to an opposite polarity to detack the sheet from belt 14. Prefuser transport 38 moves the sheet to fuser E, which permanently affixes the toner to the sheet with heat and pressure. The sheet then advances to stacker module F, or to duplex loop D.

Cleaner 40 removes toner that may remain on the image area of belt 14. In order to complete duplex copying, duplex loop D feeds sheets back for transfer of a toner powder image to the opposed sides of the sheets. Duplex inverter 90, in duplex loop D, inverts the sheet such that what was the top face of the sheet, on the previous pass through transfer, will be the bottom face on the sheet, on the next pass through transfer. Duplex inverter 90 inverts each sheet such that what was the leading edge of the sheet, on the previous pass through transfer, will be the trailing on the sheet, on the next pass through transfer.

Figure 2:
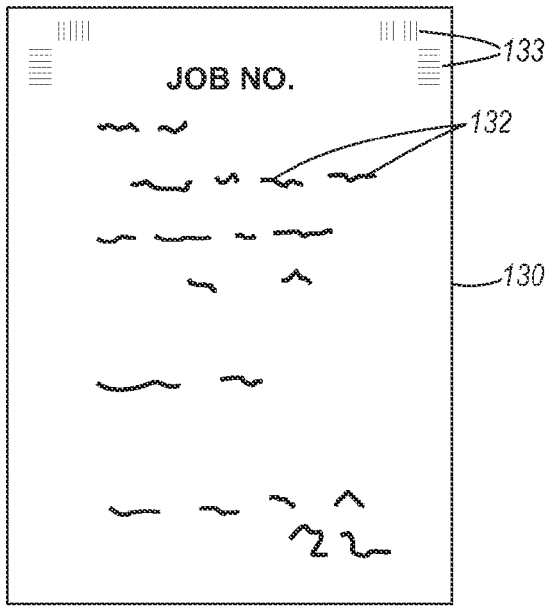
FIG. 2 is a plan view of a cover sheet with a job text description thereon and bar-codes that are read by a sensor.
Figure 3:
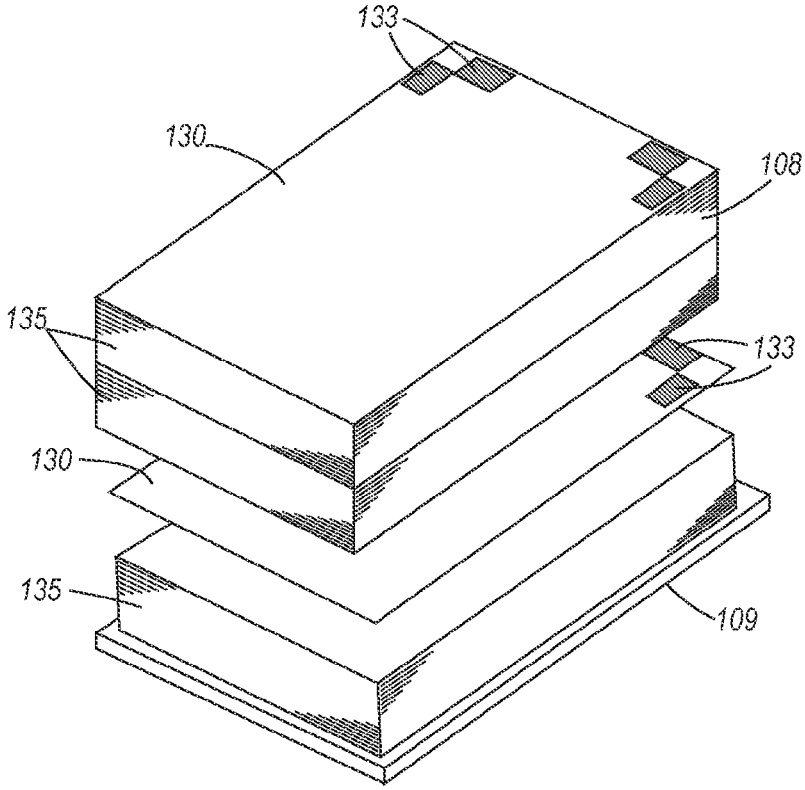
FIG. 3 is a perspective view showing stacks of copy sheets with the copy sheet stacks being separated into individual jobs by cover sheets.
Figure 4:
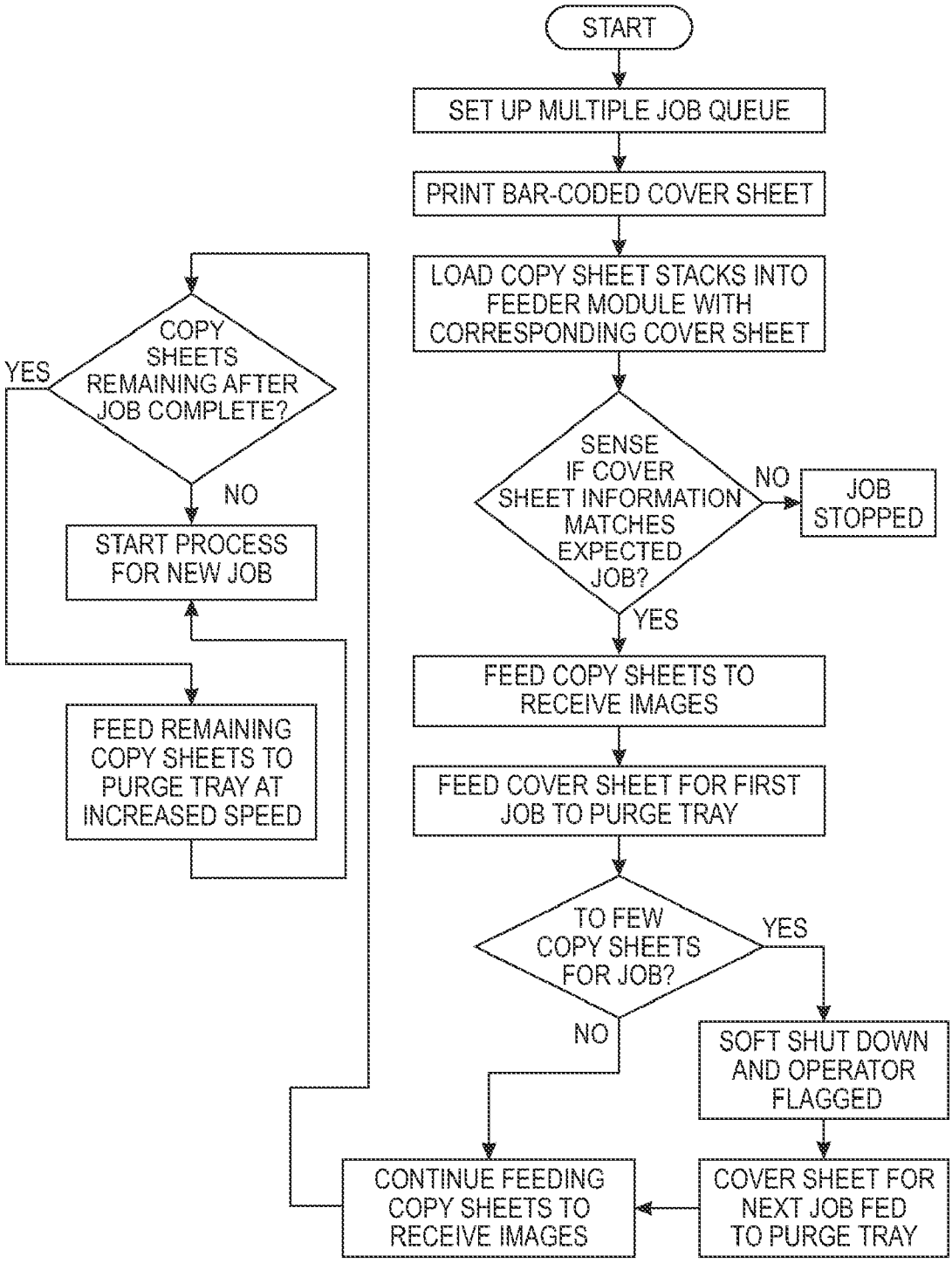
FIG. 4 is a flow chart showing overall job flow.

With further reference to FIGS. 1-4, and in accordance with the present disclosure, bar-code scanner 112 through controller 45 facilitates a productivity and convenience improvement for operators that feed many small jobs on various sheet types by allowing the printing of multiple jobs without operator intervention. In practice, a printable media description cover sheet 130 in FIG. 2 is automatically generated when a media is created in the stock library. The description cover sheet could be prepared by hand, if desired. The cover sheet will print on the appropriate size media since that is part of the stock information programmed in the stock library. The cover sheet will include a text description 132 of the media 108 and a bar-code 133 that is read by bar-code sensor or reader 112 which, alternatively, could be mounted on/in the feed head or on the trail edge media guide, which would give more time for the sensor to read the bar-code before the start of the next feed. The cover sheet is stored in media tray 109 on top of the appropriate media. This same procedure is performed for each one of multiple jobs with the cover sheets 130 separating the stacks 135 of media 108 for each job. The operator would be instructed to always load more than enough media for each job. If the operator has mis-ordered the jobs, this would be flagged because the bar-code description would not match the job cued up to be printed. Additionally, the bar-code information can also be used to automatically program subsystem settings, such as, the feeder air system when vacuum corrugated feeders are used to feed the media.

When execution of the job begins, the cover sheet 130 is feed into purge tray 118 and the rest of the media 108 beneath the cover sheet is fed for images to be placed thereon at transfer station 34 and then conveyed to a conventional stacker module F. When the job is completed, the remaining unused media in the sub-stack is fed out into purge tray 118 on top of the waiting cover sheet. This will keep the unused media properly sorted together with the cover sheet and enable the reuse of the media. The unused media could be fed into purge tray 118 at a higher page per minute rate than normal for the machine since the feeder could be capable of higher speed. This would further improve productivity by reducing delay time between jobs. The feeder will stop feeding if it sees the bar-code on top of the next sub-stack to be fed, thus avoiding a misfeed. Additionally, an optional feature could be included, such that, if a job is running and the next bar-code is seen before the job is completed (i.e., a misfeed and soft shut down occurs), the system will flag the operator on the user interface (not shown), and then use the next bar-coded cover sheet to run the next job. With this option executed, if the operator is away from the machine, all of the other jobs could be completed with only the soft stop job remaining to be completed.

Alternatively, while a method and apparatus has been disclosed embedded within a printer for stacking different types of same-sized sheets for multiple jobs in a paper supply and allowing job streaming without operator intervention, it should be understood that this capability could be offered as an option.

In recapitulation, a method of loading multiple types of paper in a feed tray to allow printing of multiple jobs without operator intervention includes printing bar-coded job divider sheets for multiple jobs from information programmed in the stock library; loading the cover sheets into the paper supply tray on top of appropriate sized sheets for each job; sensing the divider information and confirming that the information matches the expected job; and setting the subsystem operating parameters for the paper type. The cover sheet is fed to a specified output tray and the job is started. When the job is completed the remaining paper is fed to the specified output tray for later use. If there are too few sheets for the job, the next divider sheet is detected and the job would stop and the system would declare a problem, and optionally, could alert the operator of the problem, for example, through a user interface, and continue feeding the remaining jobs.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A method for improving productivity by facilitating job streaming stacks of multiple types of copy sheets to receive images of multiple jobs with each job containing multiple copy sheets from a single copy sheet tray of a copy sheet feeder module for processing within an electrostatographic printer without operator intervention, including:

providing a multiple job queue;

printing bar-coded cover sheets for each of said multiple jobs from information programmed in a stock library with said bar-coded cover sheets being the only sheets within said copy sheet tray with bar-codes thereon;

loading stacks of different types of same-sized copy sheets for each job into said copy sheet tray of said copy sheet feeder module with corresponding cover sheets separating each job;

providing a bar-code sensor within said copy sheet feeder module adapted to sense the bar-codes on said bar-coded cover sheets and confirm that the information sensed is what is in the job queue and set operating parameters of said copy sheet feeder module for the copy sheet type;

providing a feed head positioned to feed copy sheets and cover sheets from said copy sheet tray of said copy sheet feeder module and initiating feeding of a bar-coded cover sheet for the first job of said multiple jobs to a copy sheet purge tray and any copy sheets remaining after the first job has been completed;

feeding copy sheets for the first job of said multiple job queue to a marking module of said electrostatographic printer to receive images thereon with said imaged copy sheets being fed to an output tray that is separate from said purge tray; and prohibiting the feeding of copy sheets from said copy sheet tray when the sensed bar-code information does not match what is in the job queue.

2. The method of claim 1, including causing a soft shut down if too few copy sheets are below said sensed bar-coded cover sheet.

3. The method of claim 2, wherein said purge tray is adapted to receive said bar-coded cover sheets from an interface module while being positioned on top of said copy sheet feeder module and upstream of said marking module of said electrostatographic printer and feeding each bar-coded cover sheet to said purge tray.

4. The method of claim 3, wherein after a job is completed, any copy sheets remaining in said single copy sheet tray are fed into said purge tray until a bar-coded cover sheet for the next job is sensed.

5. The method of claim 4, including feeding said un-used copy sheets to said purge tray at an increased speed.

6. The method of claim 4, wherein said interface module is inserted between a plurality of copy sheet trays within said copy sheet feeder module and said marking module of said electrostatographic printer, said interface module including a first copy sheet path that extends in a vertical direction and connects said purge tray with said plurality of copy sheet trays and a second and separate copy sheet path that extends in a horizontal direction and connects said plurality of copy sheet trays to said marking module.

7. The method of claim 2, including alerting an operator that too few copy sheets are below said sensed bar-coded cover sheet and then running the next job and any remaining jobs.

8. The method of claim 1, wherein if a job is running and the next bar-coded cover sheet is seen before the job is completed a signal alert for an operator is given, and then the next bar-coded cover sheet is used to run the next job.

9. A reprographic device includes a method of loading multiple types of copy sheets in a copy sheet tray of a copy sheet feeder module to allow printing of multiple jobs in job streaming fashion without operator intervention, including:

providing bar-coded cover sheets for each of multiple jobs with said bar-coded cover sheets being the only sheets within said copy sheet tray with bar-codes thereon;

loading unimaged stacks of different types of same-sized copy sheets for each job into said copy sheet tray of said copy sheet feeder module with corresponding cover sheets separating each job, and wherein each of said multiple jobs include a plurality of sheets;

providing a bar-code sensor within said copy sheet feeder module adapted to sense the bar-codes on said bar-coded cover sheets and confirm that the information sensed is what is in a job queue;

providing a feed head positioned to feed copy sheets and cover sheets from said copy sheet tray of said copy sheet feeder module and initiating feeding of a bar-coded cover sheet for the first job of said multiple jobs to a copy sheet purge tray and the imaged copy sheets to a different tray;

feeding copy sheets for the first job of said multiple job queue to a marking module of said reprographic device to receive images thereon; and prohibiting the feeding of copy sheets from said copy sheet tray when the sensed bar-code information does not match what is in the job queue.

10. The method of claim 9, including providing an interface module positioned between said copy sheet feeder module and a marking module of said reprographic device, said interface module including a copy sheet path that connects said copy sheet purge tray with said copy sheet tray for the feeding of cover sheets thereinto and a copy sheet path that connects said copy sheet tray to said marking module and to said different tray for the feeding copy sheets to receive images thereon from said marking module.

11. A method for improving productivity when feeding stacks of multiple types of copy sheets to receive images of multiple jobs with each job containing multiple copy sheets from a selected copy sheet tray of a copy sheet feeder module for processing within an electrostatographic printer by job streaming said multiple jobs without operator intervention, including:

providing a multiple job queue;

providing bar-coded cover sheets that include bar-codes on only one side thereof for each of said multiple jobs with said bar-coded cover sheets being the only sheets within said copy sheet tray with bar-codes thereon;

loading stacks of different types of same-sized copy sheets for each job into said copy sheet tray of said copy sheet feeder module with corresponding cover sheets separating each job;

providing a bar-code sensor within said copy sheet feeder module adapted to sense the bar-codes on said bar-coded cover sheets and confirm that the information sensed is what is in the job queue and set operating parameters of said copy sheet feeder module for the copy sheet type;

providing a feed head positioned to feed copy sheets and cover sheets from said copy sheet tray of said copy sheet feeder module and initiating feeding of a bar-coded cover sheet for the first job of said multiple jobs to a copy sheet purge tray and any copy sheets remaining after the first job has been completed and feeding imaged copy sheets to an output tray;

feeding copy sheets for the first job of said multiple job queue to a marking module of said electrostatographic printer to receive images thereon with said imaged copy sheets being fed to said output tray; and prohibiting the feeding of copy sheets from said copy sheet tray when the sensed bar-code information does not match what is in the job queue.

* * * * *